US006024623A

United States Patent [19]

Menow et al.

[11] Patent Number: 6,024,623

[45] Date of Patent: Feb. 15, 2000

[54] BUBBLE MAKING TOY

[75] Inventors: Steven M. Menow, Solon, Ohio; Jeffery G. Rehkemper, Chicago, Ill.; Lewis Ray Dyson, Milford, Ohio

[73] Assignee: OddzOn, Inc., Pawtucket, R.I.

[21] Appl. No.: 09/130,729

[22] Filed: Aug. 7, 1998

[51] Int. Cl.[7] ..... A63H 33/28; A63H 1/00; A63H 33/02

[52] U.S. Cl. ..... 446/15; 446/16; 446/238; 446/451

[58] Field of Search ..... 446/15, 16, 17, 446/18, 19, 20, 21, 237, 238, 411, 448, 449, 450, 451

[56] References Cited

U.S. PATENT DOCUMENTS

| | | | |
|---|---|---|---|
| Re. 32,973 | 7/1989 | Panzarella . | |
| D. 376,394 | 12/1996 | Raucci et al. . | |
| 2,675,641 | 4/1954 | Baggott | 46/15 |
| 2,746,205 | 5/1956 | Raizen | 446/17 |
| 4,016,673 | 4/1977 | Constance | 446/15 |
| 4,299,049 | 11/1981 | Pimentel et al. . | |
| 4,367,608 | 1/1983 | Melotti . | |
| 4,423,565 | 1/1984 | Bart . | |
| 4,481,731 | 11/1984 | La Fata et al. . | |
| 4,556,392 | 12/1985 | Chang . | |
| 4,576,582 | 3/1986 | Panzarella | 446/16 |
| 4,764,141 | 8/1988 | D'Andrade | 446/16 |
| 4,775,348 | 10/1988 | Collins . | |
| 4,840,597 | 6/1989 | Perez . | |
| 4,955,840 | 9/1990 | Moomaw . | |
| 4,957,464 | 9/1990 | Perez . | |
| 5,224,893 | 7/1993 | Routzong et al. . | |
| 5,360,362 | 11/1994 | Cernansky et al. . | |
| 5,366,402 | 11/1994 | Rudell et al. . | |
| 5,395,274 | 3/1995 | Myers . | |
| 5,462,469 | 10/1995 | Lei . | |
| 5,498,191 | 3/1996 | DeMars . | |
| 5,520,564 | 5/1996 | DeMars . | |
| 5,542,869 | 8/1996 | Petty . | |
| 5,643,035 | 7/1997 | Freese et al. . | |
| 5,664,947 | 9/1997 | Dietterich et al. . | |
| 5,695,379 | 12/1997 | Ho . | |

FOREIGN PATENT DOCUMENTS

| | | | |
|---|---|---|---|
| 2186199 | 8/1987 | United Kingdom | 446/15 |

*Primary Examiner*—D Neal Muir
*Attorney, Agent, or Firm*—Marshall, O'Toole, Gerstein, Murray & Borun

[57] ABSTRACT

A bubble making toy includes a bubble making device having an impeller and a bubble wheel including a plurality of apertures. The bubble wheel rotates within a bubble making fluid reservoir for forming a film of bubble making fluid over the apertures. The impeller is arranged to rotate within an impeller housing and delivers a flow of air through the apertures for forming a substantially continuous stream of bubbles. Each of the impeller and the bubble wheel are driven from a drive axle to which at least one wheel is secured, and preferably, each are driven at a respective rotational velocity that is a respective multiple of the rotational velocity of the at least one wheel.

21 Claims, 3 Drawing Sheets

BUBBLE MAKING TOY

FIELD OF THE INVENTION

The present invention relates generally to toys, and more particularly, to a bubble making toy that may be pulled or pushed to make substantially continuous streams of bubbles.

BACKGROUND OF THE INVENTION

Toys including a bubble making device are known. For example, in United States Pat. No. Re. 32,973 a toy lawn mower is shown arranged with a bubble blowing device. The bubble blowing device includes a fan and a bubble wheel and receives driving input torque from wheels journally supporting the toy above the ground. More particularly, a belt engages a wheel axle to provide driving torque with movement of the toy to a gear train. The gear train includes a drive gear coupled to the fan and an indexing mechanism coupled to the bubble wheel. The bubble wheel is essentially a circular disk with a very shallow convex shape formed to include several round apertures. The indexing mechanism increments the bubble wheel through a fixed angular displacement causing the apertures to be sequentially dipped into a reservoir of bubble making solution and brought into contact with a stream of air generated by the fan. There are several drawbacks to the design of this toy. One, for example, lies with the incremental rotation of the bubble wheel, which limits the number of bubbles created. Instead of producing a substantially continuous stream bubbles as is highly desired, only several bubbles at a time are produced in discontinuous puffs.

As the primary purpose of a bubble making toy is to make bubbles, it is most desirable to produce large quantities of bubbles. It is also preferred in a push or pull bubble making toy to produce the bubbles in a substantially continuous stream as the toy is moved about. However, care must be taken to ensure the bubble making fluid is not foamed by the bubble making device. Foam is the scourge of bubble making as it is almost completely unusable for that purpose.

Thus, there is a need for a bubble making toy which can produce continuous streams of large quantities of bubbles without foaming the bubble making fluid.

SUMMARY OF THE INVENTION

Provided is a bubble making toy that a child may walk-behind, push or pull and which produces bubbles in large quantities in substantially continuous streams. The bubble making toy includes a bubble making device supported within a chassis, which is journally supported on wheels for movement over the ground. A decorative body is secured over the chassis, and a handle is secured to the body for walk-behind play or may be removed for push or pull play.

The bubble making device includes a bubble wheel formed with a plurality of bubble making apertures and an impeller. The bubble wheel and fan are driven in substantially continuous rotational motion with movement of the toy. The bubble wheel is in fluid communication with a reservoir of bubble making fluid which forms a film over the bubble making apertures. The impeller provides a stream of air which is directed through the bubble making apertures to produce bubbles in continuous streams. The bubble making device receives driving input torque from at least one of the wheels.

In one preferred embodiment of the present invention, the impeller is driven at a first rotational velocity while the bubble making wheel is driven at a second rotational velocity. The first and second rotational velocities each being a multiple of a rotational velocity of the at least one wheel.

An important aspect of the present invention is to guard against foaming of the bubble making fluid as the bubble wheel is rotated through the reservoir. In another preferred embodiment of the present invention, a governor is provided between the at least one wheel and a gear train coupling the at least one wheel to each of the bubble wheel and the impeller. The governor limits rotation of the bubble wheel above a predetermined rotational.

In another aspect of the present invention, a clutch is provided coupling between the at least one wheel and the bubble wheel. The clutch is arranged to allow the bubble wheel to slip, relative to the at least one wheel, should an object become caught in or engaged with the bubble wheel.

In still another preferred embodiment of the present invention, the bubble wheel is formed as a cylinder disposed over the impeller providing a very compact design as well as ensuring that substantially all of the air flow from the impeller is directed through the bubble making apertures.

In yet another preferred embodiment of the present invention, the impeller is disposed within an impeller housing to further enhance and concentrate the air flow through the bubble making apertures.

BRIEF DESCRIPTION OF THE DRAWINGS

These and many additional advantages and features of the present invention will be understood from the following detailed description of several preferred embodiments in conjunction with the attached drawings wherein.

DETAILED DESCRIPTION OF THE PREFERRED EMBODIMENT

In accordance with the preferred embodiments of the present invention, a bubble making toy includes a bubble making device for producing numerous bubbles in substantially continuous streams. The bubble making toy may be arranged for walk-behind, push or pull play and is further adaptable to numerous decorative configurations. A preferred embodiment described below takes the form of a toy fire truck, although one will readily appreciate that virtually any decorative form may be applied to the present invention without departing from its fair scope.

Figure 1:
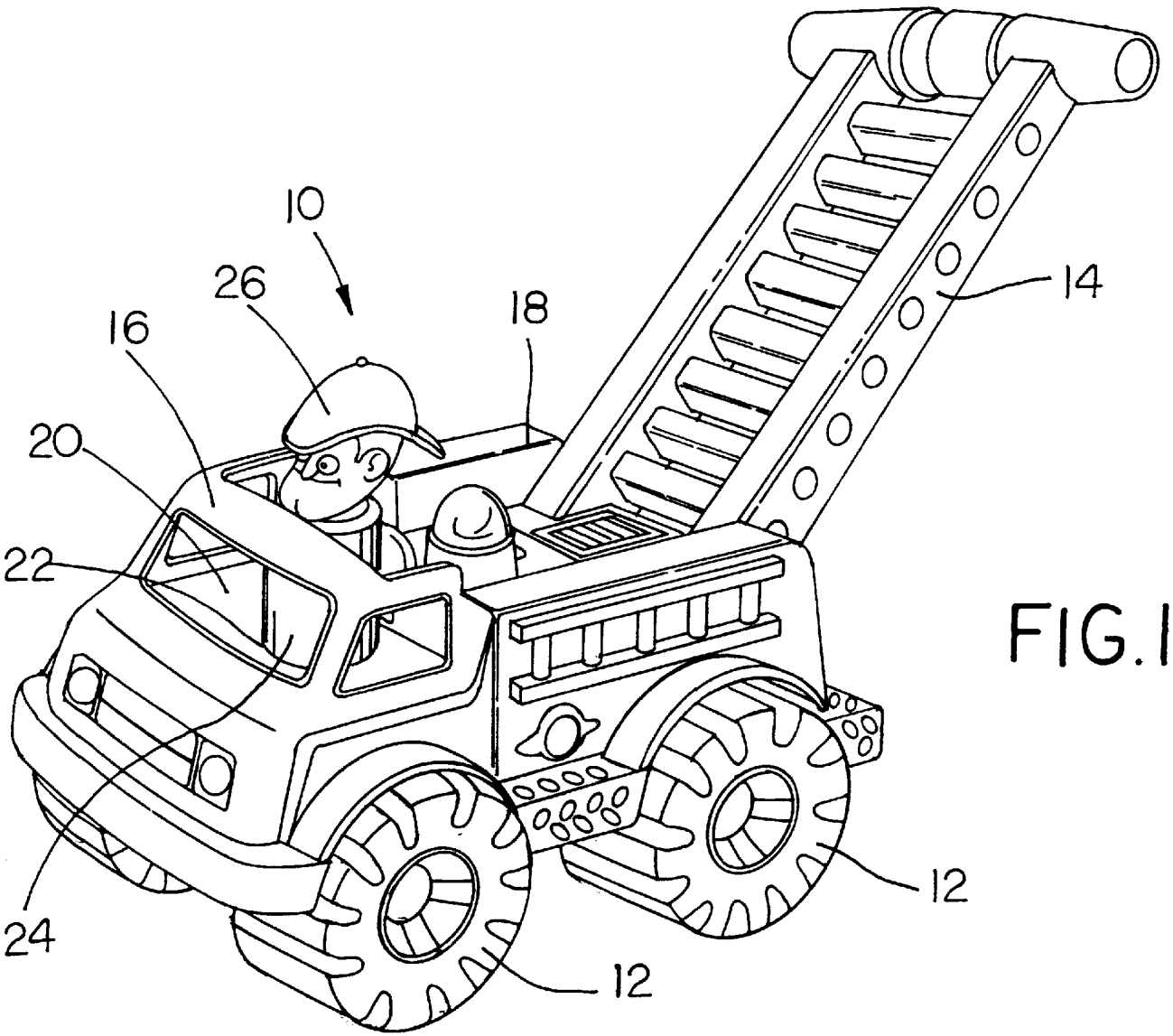
FIG. 1 is a perspective view of a pull or push bubble making toy in accordance with a preferred embodiment of the present invention.

With reference then to FIG. 1 of the drawings, a bubble making toy 10 in the form of a toy fire truck is supported for movement on wheels 12. Toy 10 also includes a releasably secured walk-behind handle 14. Handle 14 is configured, in the fire truck theme, as a ladder extending from a body portion 16, which is secured to a chassis portion 20. Of course in other themes, for example a tow truck, handle 14 is appropriately configured. Handle 14 is further attached using releasable snap in place engagement as is well known in the art. With handle 14 secured to toy 10, toy 10 is configured for walk-behind play. Handle 14 may be further used to pull toy 10. With handle 14 removed, toy 10 may be used as a push toy and pushed by hand or a string may be used to pull toy 10. As will be described, movement of toy 10, and particularly rotation of wheels 12, causes the generation of bubbles from bubble outlet aperture 18 formed in body portion 16.

Chassis 20 is formed with a receptacle 22 for receiving a bottle 24 of bubble making fluid. A bottle top 26 is roto-molded in the shape of a fireman's head. Also, a typical bubble making wand (not shown) is secured to an underside portion of bottle top 26 and extends into bottle 24 when the top is secured thereto.

Figure 2:
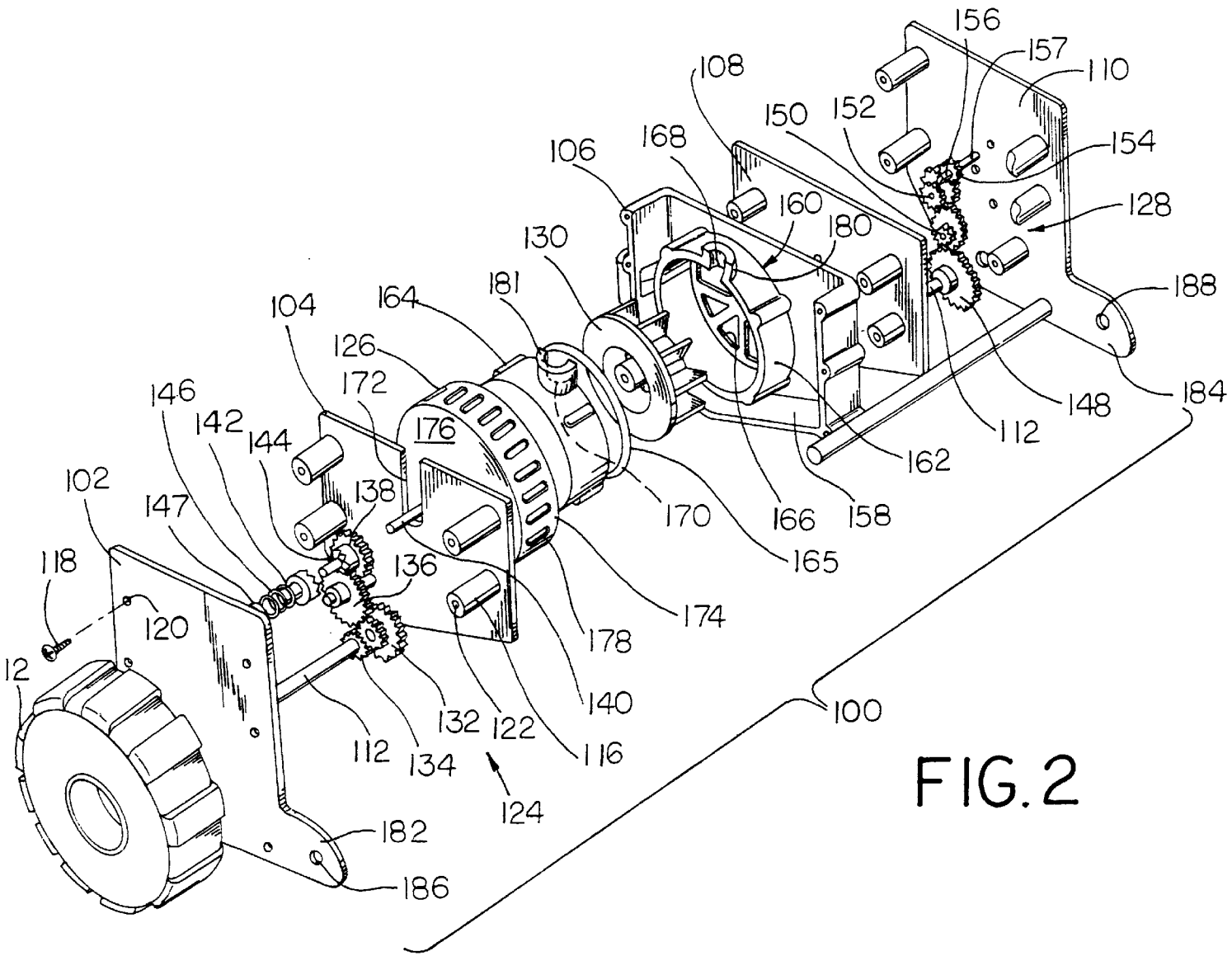
FIG. 2 is an exploded assembly perspective view of a bubble making device for use in the bubble making toy shown in FIG. 1.

Referring to FIG. 2, bubble making device 100 includes frame members 102, 104, 106, 108 and 110 which join together to form a frame. The frame is supported on a drive axle 112 which couples to a first wheel 12 and a second wheel (not shown in FIG. 2). In accordance with a preferred embodiment of the present invention, bubble making device 100 is secured to chassis 20, for example using threaded fasteners engaging apertures 186 and 188 formed in ears 182 and 184 of frame members 102 and 110, respectively. The two rear wheels of toy 10 thus support the frame, while the two front wheels of toy 10 are suitably journally secured, such as on an axle, to front portion of chassis 20. Rotation of the rear wheels when toy 10 is moved over the ground provides driving torque from at least one wheel 12 to drive axle 112 for driving bubble making device 100.

Frame member 104 and frame member 106 combine to define a bubble fluid reservoir 158. Frame member 106 is further formed to include a first portion 162 of a impeller housing 160. An impeller 130 is secured to an impeller sleeve shaft 156 journally supported on a support pin 157 formed on frame member 110. Impeller 130 is disposed within impeller housing 160 and is sealed from bubble fluid reservoir by a housing second portion 164 that is secured to first portion 162 such as by threaded fasteners, adhesive, sonic welding or the like. If needed, a suitable seal member 165, such as an o-ring seal, is provided between first portion 162 and second portion 164 to prevent bubble making fluid from entering impeller housing from bubble fluid reservoir 158.

Within impeller housing 160, frame member 106 is formed with a plurality of apertures, one shown as 166, through which impeller 130 draws air. First portion 162 and second portion 164 each include a semi-circular cut out, 168 and 170, respectively, that together form an air outlet passage from impeller housing 160. Thus, rotation of impeller 130 in impeller housing 160 draws air in through apertures 166 and expels air out through the air outlet passage.

A bubble wheel 126 is disposed within bubble reservoir 158 and secured to a bubble wheel sleeve shaft 140. Bubble wheel shaft 140 is journally supported on a support pin formed on frame member 102 and extends through a cut-out portion 172 of frame member 104. Bubble wheel 126 is formed having a cylinder wall portion 174 and an end portion 176. Cylinder wall portion 174 is formed with a plurality of bubble making apertures 178, which preferably have an oval or slot shape to increase the number of apertures 178 that may be formed in cylinder wall portion 174. Bubble wheel 126 is further disposed over impeller housing 160. When bubble wheel 126 is caused to rotate, and with a quantity of bubble making fluid disposed within bubble fluid reservoir 158, bubble making fluid forms a film over apertures 178. Air expelled from impeller housing 160 is communicated through apertures 178 thereby forming bubbles.

The substantial number of apertures 178 that may be formed in bubble wheel 126, the ability to continuously rotate bubble wheel 126 with respect to impeller housing 160 and the velocity of the air flow generated by impeller 130 combine to produce a substantial number of bubbles in a continuous stream. As can be further seen in FIG. 2, a first duct member 180 and a second duct member 181 are formed adjacent cut-outs 168 and 179, respectively on impeller housing 160, and combine to form an air outlet passage duct. The air outlet passage duct acts to direct the air flow as it passes through apertures 178. The direction of the air flow impacts the direction of the bubble stream, and thus, the duct permits the bubble stream to be directed substantially upward to prevent the bubbles from contacting the ground and thus allowing them to last longer and/or forward to prevent the bubbles from floating toward and into handle 12.

With continued reference then to FIG. 2, each of frame members 102–110 are preferably formed from molded plastic, such as ABS plastic, or similar material and further include a plurality of molded boss structures, one shown for example as 116, for providing appropriate spacing between each of frame members 102–110. Frame members 102–110 are preferably held together using a plurality of threaded fasteners, one shown for example as 118, which pass through apertures formed in each of frame members 102–110, one shown for example as 120, and engage apertures, one shown as 122, formed in bosses 116. Of course it will be appreciated that other methods of retaining frame members 102–110 together, such as bonding or sonic welding, may be used without departing from the fair scope of the present invention.

Bubble making device 100 includes a first gear train 124 adapted to engage drive axle 112 and to provide drive torque to bubble wheel 126. Bubble making device 100 also includes a second gear train 128 adapted to engage drive axle 112 and to provide drive torque to impeller 130. More particularly, first gear train 124 includes a combo gear 132 adapted to engage a pinion 134 secured to drive axle 112 for rotation therewith. Combo gear 132 engages idler gear 136 which engages clutch combo gear 138. Clutch combo gear 138 engages a pinion (not seen in FIG. 2) coupled to bubble wheel drive shaft 140. First gear train 124 provides a desired reduction from a rotational velocity of wheel 12 to a desired rotational velocity of bubble wheel 126. Preferably an about 1:4 reduction is provided. As will be appreciated, each of the gear members herein described are suitably journalled on pins formed on or secured to frame members 102–104. Most preferably, pins are molded concomitantly with molding frame members 102–104. Also, it should be noted that the various gear members are preferably formed from delrin, nylon or the like, while the various shafts and pins may be stainless steel or plastic.

Clutch 142 is urged against a clutch portion 144 of clutch combo gear 138 by a clutch spring 146. Clutch 142 and clutch spring 146 are held in place by and freely rotate around a pin member (not shown) with an end of clutch spring 146 bearing against a washer 147 disposed between it and frame member 102. Idler gear 136 engages each of clutch 142 and clutch portion 144 for transferring driving torque to clutch combo gear 138 and hence to bubble wheel 126. Clutch 142 further acts to limit the amount of torque transferred to combo gear 138 and therefore the rotational velocity of combo gear 138. When the amount of torque input, as a result of toy 10 being moved rapidly along the ground, exceeds by the force exerted by spring 146 to keep clutch 142 in engagement with clutch portion 144, clutch 142 is urged away from clutch portion 144 and idler gear 136 slips with respect to clutch combo gear 138. In this manner the rotational velocity of bubble wheel 126 within bubble making reservoir 158 is limited. Limiting the rotational velocity of bubble wheel 126 substantially reduces foaming of the bubble making solution within reservoir 158. Clutch 142 further acts to allow bubble wheel 126 to slip should an object become caught in or engaged with bubble wheel 126.

Second gear train 128 includes a drive gear 148 secured to drive axle 112 that engages a combo gear 150. Combo gear 150 further engages a combo gear 152 that engages impeller pinion gear 154 secured to an impeller drive shaft 156. Second gear train 128 provides a desired increase from the rotational velocity of wheel 12 to a desired rotational velocity of impeller 130. As will be appreciated, providing a first gear train 124 and a second gear train 128 permits adjustment of the rotational velocities of each with respect to wheel 12. Thus, impeller 130 may be driven at a sufficient rate to generate a substantial air flow, and preferably an about 40:1 gear up ratio is provided. Bubble wheel 126 may be driven, and limited as described, to provide for maximum bubble output without foaming of the bubble making fluid.

Figure 3:
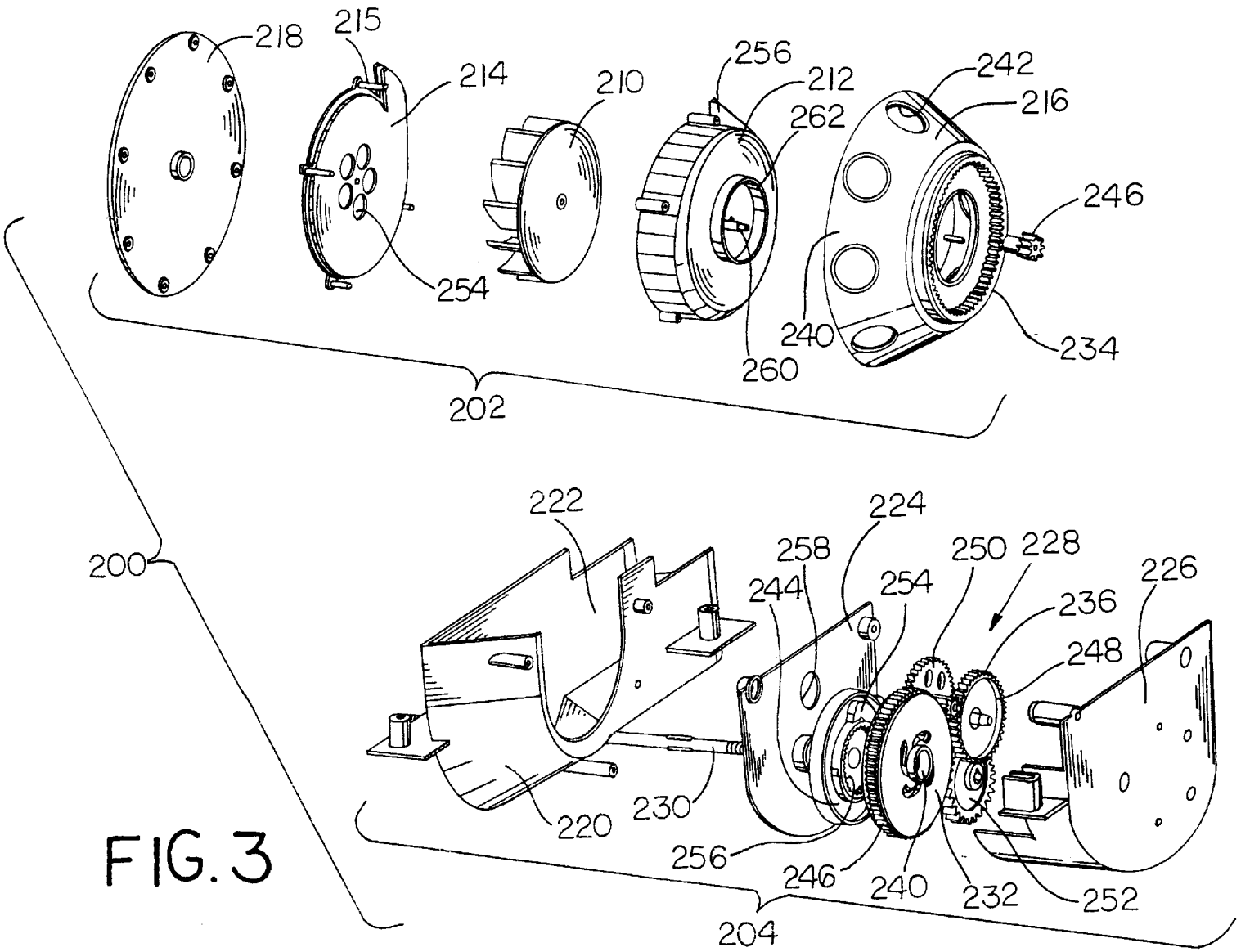
FIG. 3 is an exploded assembly perspective view of a bubble making device for use in the bubble making toy shown in FIG. 1 and in accordance with an alternate preferred embodiment of the present invention.

Referring now to FIG. 3 of the drawings, a bubble making device 200 in accordance with an alternate preferred embodiment of the present invention is shown an includes a bubble wheel assembly 202 coupled to a drive assembly 204. Bubble wheel assembly 202 advantageously incorporates into an assembly 1) an impeller 210, within an impeller housing formed from first impeller housing portion 212 and second impeller housing portion 214 joined by snap fasteners 215 or other suitable means and 2) a bubble wheel 216 including a bubble wheel cover 218 enclosing the impeller housing. Bubble wheel 216 is advantageously formed having a frustoconical surface 240 in which a plurality of round bubble making apertures, one shown as 242, is formed. The angle of surface 240, preferably about 30 degrees, is adapted to direct bubbles upwardly to allow them to last longer and forwardly with respect to toy 10, so that bubbles exiting aperture 18 do not immediately contact handle 14.

Drive assembly 204 includes a bubble making fluid reservoir 220 including a bubble fluid chamber 222, an intermediate plate member 224 and an end-plate member 226. A gear train 228 is operatively retained between intermediate plate member 224 and end-plate member 226 and is coupled to receive driving torque from an axle shaft 230 coupled to wheels 12 via an input gear 252 coupled to axle shaft 230.

Bubble wheel assembly 202 is disposed within bubble fluid chamber 222, and bubble wheel 216 is coupled to gear train 228 to receive driving torque. An input gear 252 is coupled to a drive axle 230 and rotates with wheels 12 also secured to drive axle 130. Drive torque is coupled via an intermediate gear 248 to a pinion gear 236 and then to external teeth 246 of a clutch 232. Clutch 232 includes clutch fingers 238 formed adjacent a hub portion 240 which engage an internal ratchet 256 formed in cam member 244. Driving torque is then coupled from cam member 244 to internal teeth 234 formed on bubble wheel 216 via an external gear portion of cam member 244, not shown. Preferably gear train 228 provides an about 1:4 gear reduction from axle 230 to bubble wheel 216. Furthermore, should an object become caught or engaged with bubble wheel 216, cam member 244 is arranged to slip relative to clutch 232, i.e., clutch fingers 238 disengage ratchet 256, and bubble wheel 216 stops.

Impeller 210 is coupled for relative rotation with respect to bubble wheel 216 to gear train 230. An impeller drive gear 246 is secured to impeller 210 via a steel shaft (not shown) and receives driving input torque from axle 230 via input gear 252 and intermediate gears 248 and 250. A gear up ratio of about 40:1 impeller 210 to axle shaft 230 is provided.

Bubble fluid chamber 222 may be filled with a suitable amount of bubble making fluid, and rotation of bubble wheel assembly within bubble fluid chamber 222 produces numerous bubble from toy 10. More particularly, rotation of impeller 210 causes a stream of air to be forced through apertures 242. Rotation of bubble wheel 216 through bubble fluid contained within bubble fluid chamber 222 causes a film of bubble making fluid to form over apertures 242. The stream of air causes the formation of bubbles and the angle of surface 240 directs the bubble on a desired direction, e.g., upward and forward and. In addition, a centrifugal brake coupled to gear train 228 may be provided to act as a speed governor. For example, it will be appreciated that one or more friction members may be arranged to contact a reaction member, such as an annular sleeve. The governor limits rotational speed of gear train 228, and thus virtually eliminates the production of foam resulting from an excess rotational velocity of bubble wheel 216 within reservoir 222, which would inhibit the formation of bubbles.

Impeller 210 draws air through apertures 254 formed in impeller housing portion 214 and expels air from an outlet passage 256 formed in impeller housing portion 212. Moreover, impeller housing 212 is formed within an annular projection 262 on which a cam follower 260 is formed and/or secured. Cam follower 260 extends through aperture 258 and engages a cam surface, shown in opposite recess at 254, of cam member 244. The cam surface is arranged substantially as a spiral with a quick set back. The cam surface causes rotation the impeller housing through a preset angle, which results in outlet passage 256 1) being advanced to a bubble aperture, 2) following this bubble aperture through a rotation of about 45 degrees, a dwell period, and 3) advancing to a next bubble aperture. Thus a substantial air flow is directed through the bubble apertures in a substantially continuous manner for a preset angular rotation. The dwell period is optimized such that passage 256 remains aligned with a bubble making aperture until substantially all of the bubble making fluid coating the aperture is removed in the form of bubbles, while ensuring that passage 256 does not dwell excessively on an aperture from which substantially all bubble making fluid has been exhausted.

Each of bubble making device 100 and bubble making device 200 are very compact, cost effective and efficient at forming bubbles. Moreover, each is adaptable for use in virtually any toy having a rotational input. Many additional changes and modifications could be made to the invention without departing from the fair scope and spirit thereof The scope of some changes is discussed above. The scope of others will become apparent from the appended claims.

We claim:

1. A bubble making toy comprising:

a plurality of wheels, at least one of the wheels coupled to impart rotational motion to a drive axle upon rotation of the at least one wheel;

a bubble fluid reservoir supported within the toy and retaining a supply of bubble fluid;

a bubble forming device supported within the toy and in fluid communication with the bubble fluid reservoir, the bubble forming device comprising:

an impeller coupled for rotational motion with the drive axle, a bubble wheel disposed adjacent the impeller and coupled for continuous rotational motion with the drive axle, the bubble wheel formed to include a plurality of bubble making apertures arranged to accept bubble fluid from the bubble fluid reservoir, and the impeller disposed within a housing and the housing formed with an air passage, the housing driven to a pivoting motion such that, the air passage is arranged to direct a flow of air from the impeller through one of the bubble making apertures to align the passage with any of the apertures during a portion of an aperture's travel past the air passage.

2. The bubble making toy of claim 1, comprising a decorative body portion, the decorative body portion including a bubble outlet passage disposed adjacent the bubble forming device.

3. The bubble making toy of claim 1 arranged for at least one of pulling and pushing on the plurality of wheels.

4. The bubble making toy of claim 3, comprising a handle member secured to and extending upwardly from the toy.

5. The bubble making toy of claim 1, the impeller arranged for rotational motion at a first rotational velocity, the first rotational velocity being a first multiple of a rotational velocity of the drive axle and the bubble wheel arranged for rotational motion at a second rotational velocity, the second rotational velocity being a second multiple of the rotational velocity of the drive axle.

6. The bubble making toy of claim 5, comprising a gear assembly coupling the drive axle to the impeller and to the bubble wheel.

7. The bubble making toy of claim 1, comprising a clutch disposed between the drive axle and the bubble wheel.

8. The bubble making toy of claim 1, comprising a speed limiting clutch coupled to at least one of the bubble wheel and the impeller.

9. The bubble making toy of claim 1, the bubble wheel comprising a cylinder portion, the bubble apertures formed within the cylinder portion.

10. The bubble making toy of claim 9, the cylinder portion comprising a frusto-conical section.

11. The bubble making toy of claim 10, the cylinder portion disposed over the impeller.

12. The bubble making toy of claim 1, the bubble making apertures comprising one of oval, apertures, slot apertures and round apertures.

13. The bubble making toy of claim 1, the air passage comprising a duct member adjacent the air passage and disposed between the housing and the bubble wheel.

14. The bubble making toy of claim 1, the housing arranged for pivoting motion with respect to the bubble wheel.

15. The bubble making toy of claim 1, further comprising a cam member coupled for rotation with the drive axle an the housing formed to include a cam follower engaging the cam member.

16. A bubble making toy comprising:

a chassis supporting a plurality of wheels, at least one of the wheels coupled to impart rotational motion to a drive axle journally secured to the chassis;

a bubble fluid reservoir supported within the chassis and retaining a supply of bubble making fluid;

a bubble forming device supported within the toy and in fluid communication with the bubble fluid reservoir, the bubble forming device comprising:

a gear train coupled to the drive axle;

a bubble wheel including a plurality of bubble making apertures, the bubble wheel disposed within the bubble fluid reservoir and coupled to the gear train for substantially continuous rotation with the drive axle; and an impeller coupled to the gear train, the impeller disposed within an impeller housing, the impeller housing pivotably disposed adjacent the bubble wheel and including an air outlet passage arranged to direct a flow of air through one of the bubble apertures when the one of the bubble apertures is aligned with the air outlet passage and stay aligned during a portion of the travel of the bubble apertures.

17. The bubble making toy of claim 16, the gear train comprising a cam member and the impeller housing formed to include a cam follower, the cam member and cam follower arranged to align the air outlet passage with a first of the plurality of bubble making apertures for a first dwell period and to align the air outlet passage with a second of the plurality of bubble making apertures for a second dwell period.

18. A bubble making toy comprising:

a plurality of wheels, at least one of the wheels coupled to impart rotational motion to a drive axle upon rotation of the at least one wheel;

a bubble fluid reservoir supported within the toy and retaining a supply of bubble fluid;

a bubble forming device supported within the toy and in fluid communication with the bubble fluid reservoir, the bubble forming device comprising:

an impeller coupled for rotational motion with the drive axle, a bubble wheel disposed adjacent the impeller and coupled for rotational motion with the drive axle, the bubble wheel formed to include a plurality of bubble making apertures arranged to accept bubble fluid from the bubble fluid reservoir, and wherein the impeller is disposed within a housing, the housing is formed with an air passage, and the housing is arranged for pivoting motion with respect to the bubble wheel such that a flow of air is directed and maintained from the impeller through the bubble making apertures.

19. A bubble making toy comprising:

a plurality of wheels, at least one of the wheels coupled to impart rotational motion to a drive axle upon rotation of the at least one wheel;

a bubble fluid reservoir supported within the toy and retaining a supply of bubble fluid;

a bubble forming device supported within the toy and in fluid communication with the bubble fluid reservoir, the bubble forming device comprising:

a cam member coupled for rotation with the drive axle;

an impeller coupled for rotational motion with the drive axle, the impeller being disposed within a housing, the housing being formed with an air passage, a cam follower formed on the housing and engaging the cam member and driving the impeller housing to pivot, a bubble wheel disposed adjacent the impeller and coupled for rotational motion with the drive axle, the bubble wheel formed to include a plurality of bubble making apertures arranged to accept bubble fluid from the bubble fluid reservoir, and wherein a flow of air is directed from the impeller through the bubble making apertures.

20. A bubble making toy comprising:

a chassis supporting a plurality of wheels, at least one of the wheels coupled to impart rotational motion to a drive axle journally secured to the chassis;

a bubble fluid reservoir supported within the chassis and retaining a supply of bubble making fluid;

a bubble forming device supported within the toy and in fluid communication with the bubble fluid reservoir, the bubble forming device comprising:

a gear train coupled to the drive axle;

a bubble wheel including a plurality of bubble making apertures, the bubble wheel disposed within the bubble fluid reservoir and coupled to the gear train for substantially continuous rotation with the drive axle;

an impeller coupled to the gear train, the impeller disposed within an impeller housing, the impeller housing disposed adjacent the bubble wheel and including an air outlet passage arranged to direct a flow of air through the bubble apertures; and the gear train comprising a cam member and the impeller housing formed to include a cam follower, the cam member and cam follower arranged to align the air outlet passage with a first of the plurality of bubble making apertures for a first dwell period and to align the air outlet passage with a second of the plurality of bubble making apertures for a second dwell period.

21. The bubble making toy of claim 20, the gear train comprising a speed limiting clutch.

* * * * *